US006286917B1

(12) United States Patent
Strong

(10) Patent No.: US 6,286,917 B1
(45) Date of Patent: Sep. 11, 2001

(54) STILE BRACKET

(75) Inventor: Ronald D. Strong, San Jose, CA (US)

(73) Assignee: Ronald Dennis Strong, San Jose, CA (US)

( * ) Notice: Subject to any disclaimer, the term of this patent is extended or adjusted under 35 U.S.C. 154(b) by 0 days.

(21) Appl. No.: 09/419,578

(22) Filed: Oct. 18, 1999

(51) Int. Cl.[7] ..... A47B 43/00

(52) U.S. Cl. ..... 312/257.1; 312/324; 312/326; 49/501

(58) Field of Search ..... 312/257.1, 265.5, 312/265.6, 138.1, 204, 324, 326, 327; 248/208; 49/501; 52/578, 579, 712, 588.1; 403/403, 382, 205

(56) References Cited

U.S. PATENT DOCUMENTS

| | | | | |
|---|---|---|---|---|
| Re. 36,853 | * | 9/2000 | Kennedy et al. | 49/501 X |
| 1,597,166 | * | 8/1926 | Meyercord | 49/501 |
| 2,438,428 | * | 3/1948 | Birdsall | 52/578 X |
| 3,023,068 | * | 2/1962 | Haag | 313/204 X |
| 3,377,748 | * | 4/1968 | Kellerhals | 49/501 |
| 3,881,794 | * | 5/1975 | Henning | 312/257.1 X |
| 3,895,849 | * | 7/1975 | Zehr | 312/324 |
| 4,453,789 | * | 6/1984 | Gullong | 312/257.1 X |
| 4,662,114 | * | 5/1987 | Suttles | 49/501 |
| 5,358,326 | * | 10/1994 | Cherry et al. | 312/265.6 X |
| 5,520,477 | * | 5/1996 | Fink | 403/403 X |
| 5,653,079 | * | 8/1997 | Loeffler et al. | 52/712 |
| 5,676,486 | * | 10/1997 | Keith | 403/403 X |
| 5,743,413 | * | 4/1998 | Noll | 403/403 X |
| 5,758,465 | * | 6/1998 | Logue | 52/712 X |
| 6,128,861 | * | 10/2000 | Calamari et al. | 49/501 |

* cited by examiner

*Primary Examiner*—Peter M. Cuomo
*Assistant Examiner*—Hanh V. Tran

(57) ABSTRACT

Center stiles in cabinet doors are ornamental and may be removed if full unfettered cabinet width is desired. This invention is for a bracket for attaching a removed center stile to an edge of the cabinet door to preserve the appearance of the original cabinet.

4 Claims, 3 Drawing Sheets

20
22
10
10
5
5

10
12
16
14
22
20

STILE BRACKET

This invention relates to cabinetry and in particular to the vertical stile between adjacent cabinet doors and its removal to permit full use of a wide cabinet.

BRIEF SUMMARY OF THE INVENTION

At the present time nearly all conventional furniture, including cabinets, is manufactured in a central factory and shipped to various wholesalers and retailers when ordered. To be competitive the furniture factories must find cost saving shortcuts that will not deleteriously affect the quality of their product.

One of the cost saving shortcuts is in the joining of adjacent cabinet doors. When abutting adjacent doors are hinged to the vertical frame stiles of the cabinet, the abutting edges opposite the hinges must be very precisely spaced. A sixteenth of an inch variation in the spacing between the top and bottom of the cabinet doors is very obvious and can easily be avoided. But avoiding that type of defect takes time and a skilled cabinetmaker which the furniture factories cannot afford.

The center cabinet stile was developed to hide variations in the spacing between the doors of a two-door cabinet. With each door of a two-door cabinet closing against a center stile, a quarter of an inch variation in spacing would be barely obvious and the installation of the stile is much less costly than the cost of precision alignment of the cabinet doors. So practically all factory made cabinets are supplied with an attached center stile.

Center stiles in cabinets are a nuisance to the home owner who needs to put a large item such as a platter, in the cabinet. Or often, one wants to install a wide pull-out shelf on extension tracks in a cabinet and is prevented from doing so by a center stile in the cabinet. The center stile has no function other than to hide carelessly installed cabinet doors; it doesn't help strengthen and brace the shelves as may be claimed by a salesperson for the factory. It is only ornamental and may be removed without damage to the intergrity of the cabinet.

This invention is for a rigid metal bracket for attaching a vertical center cabinet stile, that has been removed from the cabinet, to an edge of one of the cabinet doors. Merely nailing the stile to the door edge is not appropriate because there is insufficient material on the door edge to place a nail without splitting the door material. A pair of brackets attached to both the door and the detached stile will adequately support a stile for a three foot cabinet. An additional bracket may be added for longer doors.

BRIEF DESCRIPTION OF THE DRAWINGS

In the drawings which illustrate the prefered embodiment of the invention.

DETAILED DESCRIPTION OF THE PREFERRED EMBODIMENT

Factory assembled cabinetry is generally made with center stiles between the central edges of the two adjacent hinged doors and secured to the upper and lower rails of the door frame of the cabinet. These center stiles are often attached to the shelving in the cabinet. But the shelves do not rely upon the stile for any additional strength; in most cases the stiles are ornamental only and could be removed, if desired.

Figure 2:
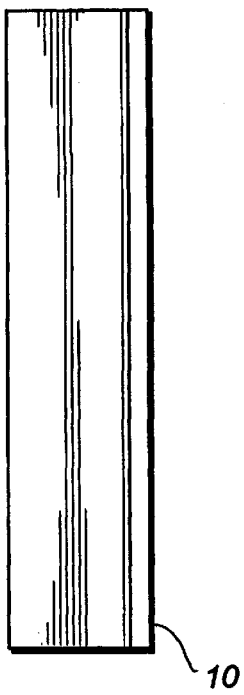
FIG. 2 is an edge view thereof.
Figure 1:
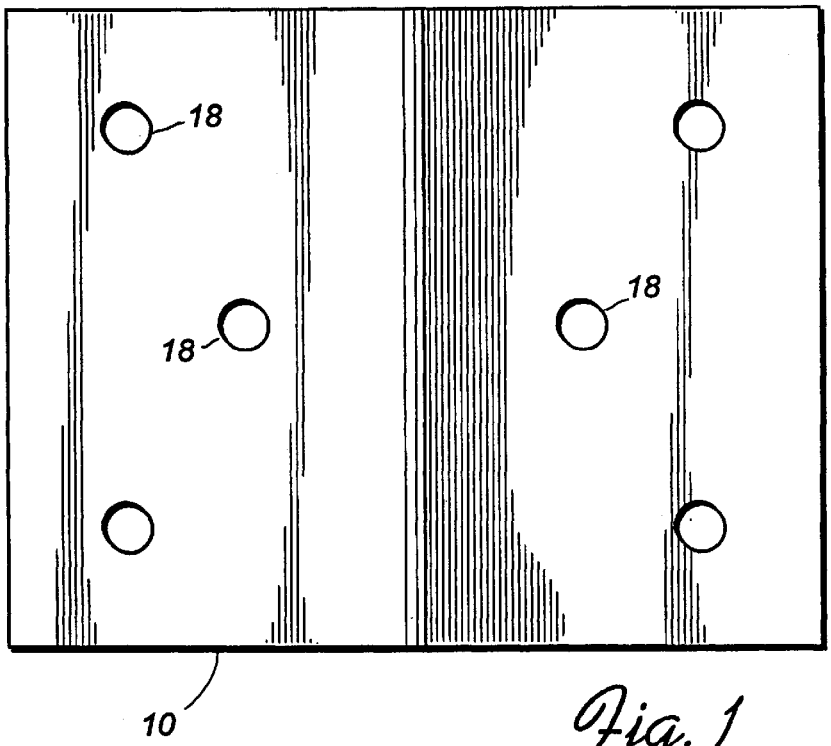
FIG. 1 is a view illustrating the side surface of my stile bracket.
Figure 3:
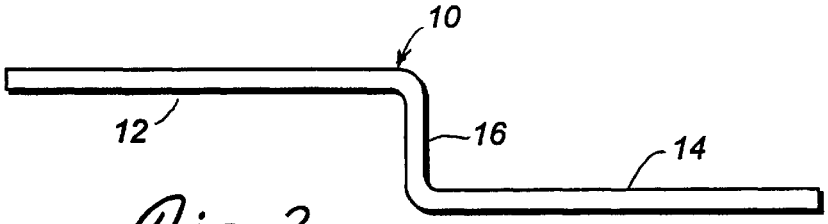
FIG. 3 if a top plan view thereof.

The bracket 10 is illustrated in FIGS. 1–3. It is a flat structural rustproof plate that is preferably an unyielding, or not easily bendable, metal. It has two parallel end sections 12, 14. The central portion of the plate, or the closest ends of the end sections, are connected by two right angle bends that produce a central offset 16 having a width equal to the thickness of the stile which has been removed from a cabinet. Typical dimensions for a bracket for a kitchen cabinet with a ⅜ inch thick center stile may be 1—1$^{1\text{-}1/4\times2}$ inches for each end section 12,14 and ⅜ inch for offset 16. Each of the end sections 12, 14 has at least three clearance holes for one-eighth diameter screws.

Figure 4:
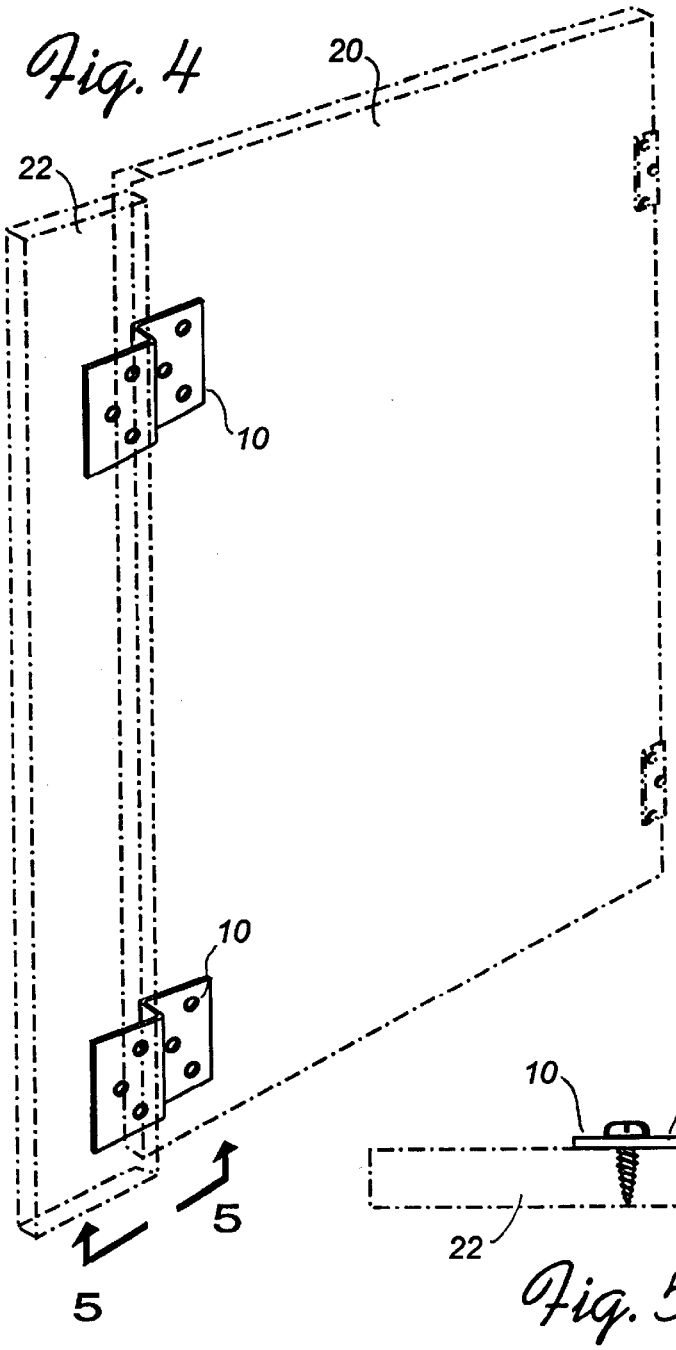
FIG. 4 is a perspective view illustrating two brackets attaching a stile to the rear surface of a cabinet door, the stile and cabinet door shown by broken lines.

FIG. 4 is a perspective view of the rear of a cabinet door 20 illustrating the installation of a removed center stile 22 using two of the brackets 10. Two brackets will rigidly secure a conventional under-the-counter cabinet of approxiamtely three feet in height; long doors may require additional brackets.

Figure 5:
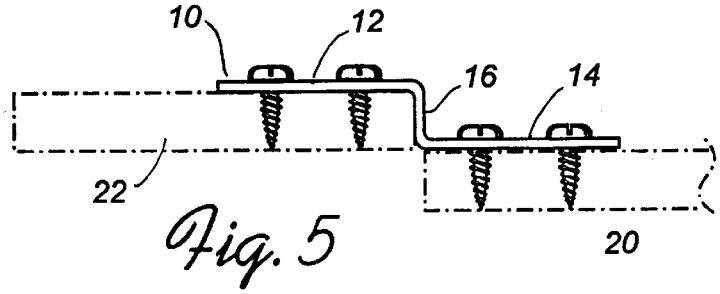
FIG. 5 is a bottom end view taken along the lines 5—5 of FIG. 4.

FIG. 5 is an end view taken along the lines 5—5 of FIG. 4 and again illustrates the installation of a stile 22 upon a cabinet door 20. It will be noted that when a bracket 10 is screwed to a stile 22 the opposite, or inner, surface of the stile is collinear with the exterior surface of the door 20. This permits an installer to adjust the stile position with respect to door 20 before the bracket 10 is screwed to the door.

Figure 7:
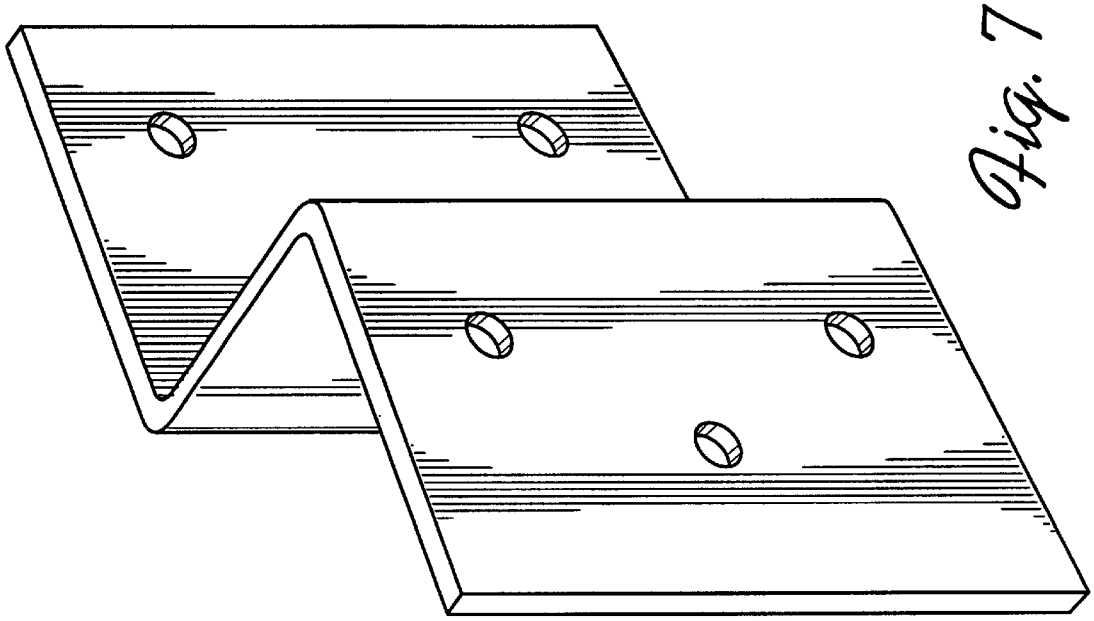
FIGS. 6 and 7 illustrate stile brackets for stiles of two different thicknesses.
Figure 6:
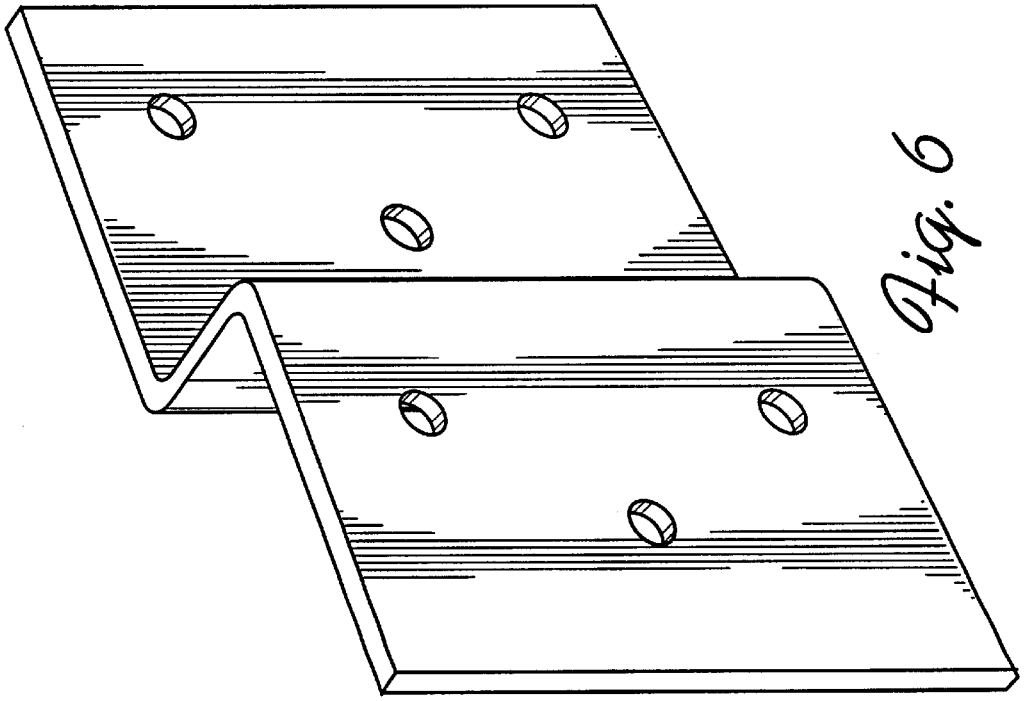

FIGS. 6 and 7 are perspective views of two brackets which are identical except for the offset. FIG. 6 illustrates a bracket with a ⅜ inch offset. FIG. 7 illustrates a bracket with a ¾ inch offset for use with a stile material of ¾ inch thickness.

I claim:

1. In a cabinet having two adjacent cabinet doors hinged on their first side edges to cabinet frame members, a bracket which attaches an ornamental center cabinet stile to an edge opposite said first side edge of one of said doors, said bracket comprising:

a member having a door plate and a stile plate, said door and stile plates being parallel and connected at the closest ends by an offset at a right angle to each of said plates, said offset having a length equal to the thickness of the ornamental center cabinet stile, said door plate extending from said offset in a direction opposite from said stile plate.

2. The bracket claimed in claim 1 wherein said door plate and said stile plate contain screw holes for attaching said member.

3. The bracket claimed in claim 1 wherein said member is formed of metal.

4. The bracket claimed in claim 3 wherein said member is rustproof.

* * * * *